US005667081A

United States Patent [19]

Pund-Hogan

[11] Patent Number: 5,667,081

[45] Date of Patent: Sep. 16, 1997

[54] ORGANIZING DEVICE FOR SORTING AND MATING SOCKS AND GARMENTS WHICH EXIST AS A PAIR OF MEMBERS

[76] Inventor: Kathleen Pund-Hogan, 11 Manor Knoll Ct., Baldwin, Md. 21013

[21] Appl. No.: 583,965

[22] Filed: Jan. 11, 1996

[51] Int. Cl.[6] ..... A47F 7/00

[52] U.S. Cl. ..... 211/10

[58] Field of Search ..... 211/10, 13, 12, 211/85, 132, 195

[56] References Cited

U.S. PATENT DOCUMENTS

| | | | |
|---|---|---|---|
| D. 281,469 | 11/1985 | Honermann | D6/317 |
| D. 311,458 | 10/1990 | La Croix | D6/315 |
| D. 323,748 | 2/1992 | La Croix et al. | D6/315 |
| 2,102,977 | 12/1937 | Shoemaker et al. | 248/223 |
| 2,401,835 | 6/1946 | McFall | 211/13 X |
| 2,541,349 | 2/1951 | Gamache | 211/87 |
| 2,612,274 | 9/1952 | Earll | 211/89 |
| 2,614,701 | 10/1952 | Mapson | 211/87 |
| 2,793,762 | 5/1957 | Broussard | 211/113 |
| 2,920,765 | 1/1960 | Royer | 211/10 |
| 2,922,528 | 1/1960 | Carlson | 211/89 |
| 3,281,102 | 10/1966 | Hobson | 248/125 |
| 3,633,802 | 1/1972 | Webster | 244/45 T |
| 3,972,094 | 8/1976 | Fuller | 24/150 SP |
| 4,739,886 | 4/1988 | Seaberg | 211/13 |

*Primary Examiner*—Alvin C. Chin-Shue
*Assistant Examiner*—Sarah L. Purol
*Attorney, Agent, or Firm*—Leonard Bloom

[57] ABSTRACT

An organizing device for sorting and mating members of a plurality of members, the mated members forming a matched set. A panel has a plurality of spaced-apart openings which are in a series of horizontal rows and staggered vertical columns. The inner surface of each opening is formed to receive and retain a member of the pair which is manually inserted into the opening. The panel is supported in a substantially upright position. A method of using the device is disclosed.

17 Claims, 6 Drawing Sheets

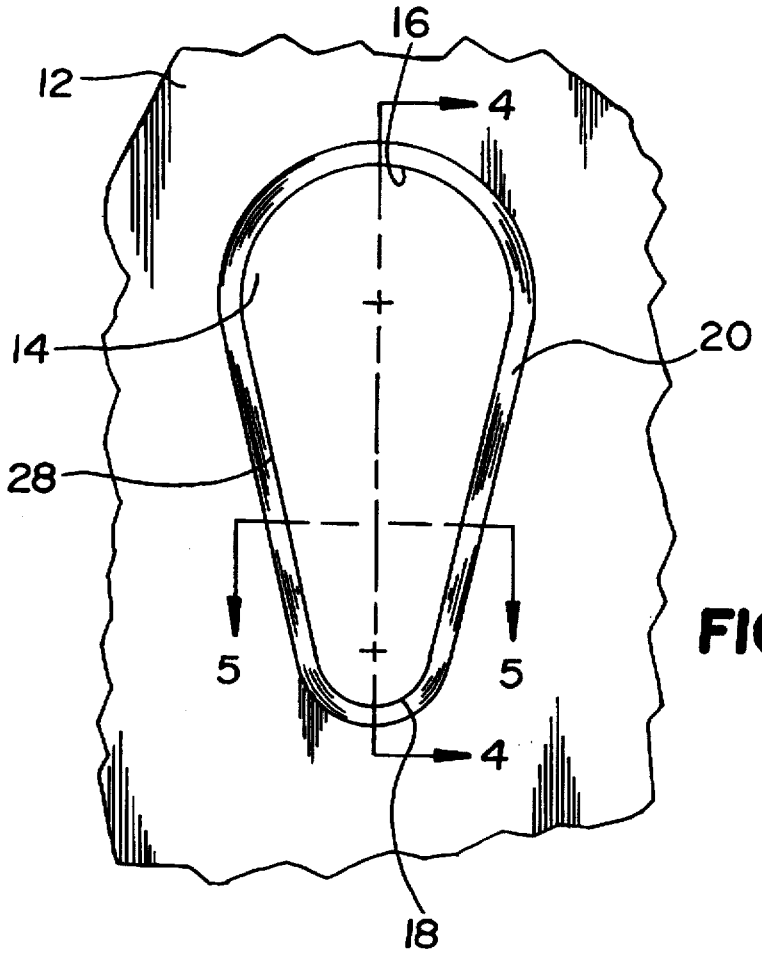
FIG. 3
FIG. 4
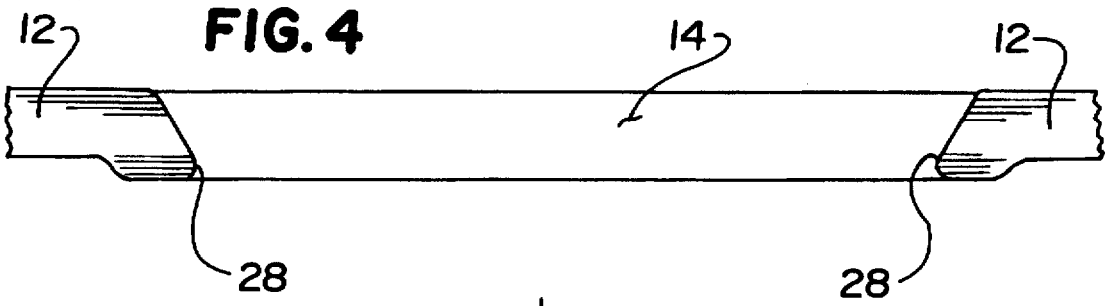
FIG. 5
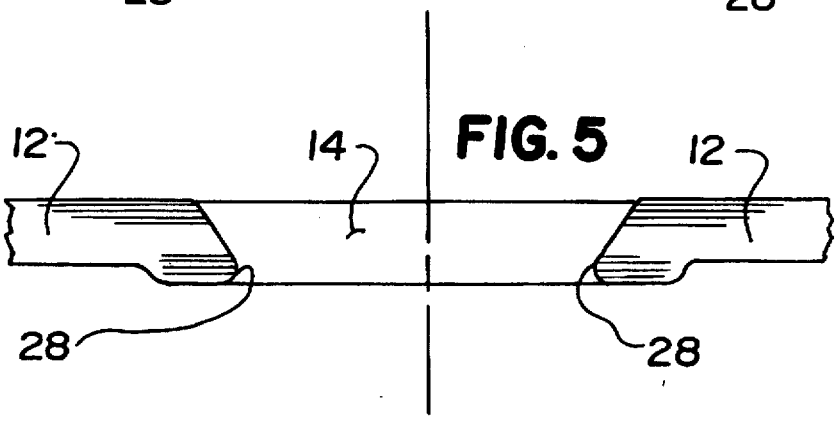

ORGANIZING DEVICE FOR SORTING AND MATING SOCKS AND GARMENTS WHICH EXIST AS A PAIR OF MEMBERS

BACKGROUND OF THE INVENTION

The present invention relates to a device for sorting and mating members of a plurality of members, the mated members forming a matched set, and more particularly to a panel having a plurality of openings therein, in which the members can be inserted and retained.

A persisting problem encountered by anyone doing laundry is the sorting and mating of members of pairs such as socks after the laundry has been dried. The most common, and time consuming, method is to lay out the clean socks on a flat surface and try to find the mates as rapidly as possible. This task is compounded by pairs of socks which are similar in color (e.g., navy blue and black) and texture. In addition, in a family of adults and children, there can be pairs having similar colors and patterns, but being of different sizes. Depending upon the size of the family, an average wash can contain ten (10) or twenty (20) pairs of socks. Also, there are other garments, in the laundry which are paired members and which also must be sorted and mated. The failure to find the mate frequently results in a "lost" member which in many instances, is discarded after a period in which a pair cannot be identified. This problem is even more acute in commercial applications where the numbers of such garments is significantly greater than in a residential or family application.

There have been efforts directed to solving this long-existing problem. The applicant is aware of the following U.S. patents which disclose devices for drying, holding and/or pairing socks and other articles of clothing.

| U.S. Pat. No. | Inventor(s) |
|---|---|
| 2,541,348 | Gamache |
| 2,612,274 | Earll |
| 2,793,762 | Broussard |
| 2,920,765 | Royer |
| 2,922,528 | Carlson |
| 3,633,802 | Webster |
| 3,972,094 | Fuller |
| D 281,469 | Honerman |
| D 311,458 | La Croix |
| D 323,748 | La Croix |

None of the above references disclose a panel having a plurality of specifically shaped openings which permit simple insertion of the sock or garment so that the sock or garment is readily visible for mating with a second member of a pair. Further, none of the references disclose a means for securely supporting the panel in a substantially upright position so that a portion of one member of the pair may be easily inserted into one of the openings and the member is displayed for subsequent mating with the other member of the pair.

The applicant is also aware of the following which disclose display devices:

| U.S. Pat. No. | Inventor(s) |
|---|---|
| 2,614,701 | Mapson |
| 2,102,977 | Shoemaker et al |
| 3,281,102 | Hobson |

None of these devices are used for articles of clothing nor for mating pairs of items. Also these devices do not have openings configured either to facilitate manual insertion of an article of clothing or to display a portion of the article of clothing to permit comparison for mating pairs of the articles of clothing.

Thus, there remains a need for a simple, easy to use device to sort and mate socks and other garments which exist as a pair of members.

BRIEF SUMMARY OF THE INVENTION

It is an object of the present invention to provide a simple organizing device in which socks and garments which exist as a pair of members may have one member removably retained and displayed so that the other member can be mated thereto.

In accordance with the teaching of the present invention there is disclosed herein an organizing device for sorting and mating members of a plurality of members, the mated members forming a matched set. The device includes a panel having a front surface, a back surface, and a plurality of spaced-apart openings formed therethrough. The openings are in a series of horizontal rows and staggered vertical columns. Each opening has a top, a bottom and a smooth inner surface thereabout. The top and the bottom each has a width, the width of the top being greater than the width of the bottom. The inner surface of each opening is inclined inwardly from one of the surfaces of the panel to an apex and is arcuate from the apex to the other of the surfaces of the panel. A portion of one member of the set is manually inserted from the front of the panel into the top of the respective opening and pushed into said opening downwardly toward the bottom of the opening. In this manner, the portion of said member is removably retained in the respective opening and another portion of said member of the set hangs downwardly from the bottom of the respective opening on the front of the panel, thereby displaying said member for mating with a second member of the set. A plurality of members of the sets are inserted and retained in the corresponding plurality of openings. Means are provided for securely supporting the panel in a substantially upright position.

These and other objects of the present invention will become apparent from a reading of the following specification taken in conjunction with the enclosed drawings.

BRIEF DESCRIPTION OF THE DRAWINGS

FIG. 3 is an enlarged front elevational view showing an opening in the panel of the present invention.

FIG. 4 is a cross-sectional view taken across the lines 4—4 of FIG. 3.

FIG. 5 is a cross-sectional view taken across the lines 5—5 of FIG. 3.

DESCRIPTION

Figure 1:
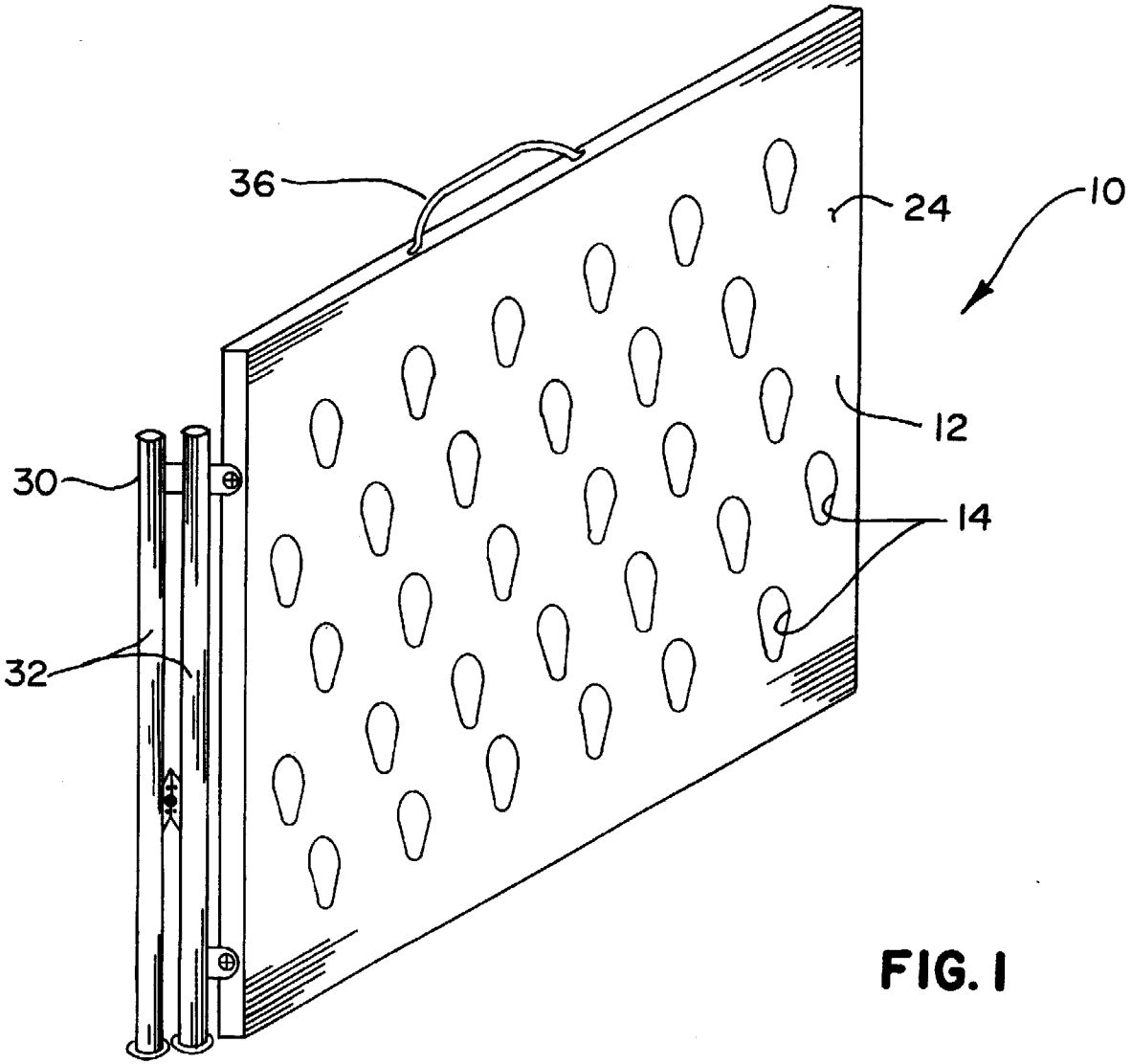
FIG. 1 is a perspective view of the present invention showing the front of the device.

Referring now to FIGS. 1–5, the organizing device 10 is a substantially flat panel 12 having a height, width and thickness. These dimensions are not critical but may be changed to meet the use requirement. The thickness of the panel 12 must be sufficient so that the panel 12 is rigid; however, a thickness of approximately ¼ inch is preferred around the opening 14. Preferably, the panel 12, is thicker around the openings 14 and around the periphery of the panel 12. The panel 12 is thinner between the openings 14 to reduce the weight of the panel 12 and to reduce the cost of material used to fabricate the panel 12. A plurality of spaced-apart openings 14 are formed through the panel 12. The openings 14 are preferably in a series of horizontal rows and staggered vertical columns as will be described.

Each opening 14 has a top 16, a bottom 18 and a smooth inner surface 20 around the periphery of the opening 14. The top 16 and the bottom 18 each have a width. The width of the top 16 is greater than the width of the bottom 18. Preferably, the top 16 of the opening 14 is an arc having a diameter ranging between 1⅝–2 inches. This corresponds to the maximum width of the opening 14. If the diameter is greater, the number of openings 14 which can be formed in the panel 14 is reduced which is wasteful of the available space. Further, an increased width offers no advantages in inserting the sock in the opening 14. If the width is reduced, it becomes difficult to insert a more bulky sock into the opening 14. The bottom 18 of the opening 14 may be angular as a "V" or may be an arc having a diameter up to ½ inch. If the diameter (width of the bottom 14) is greater than ½ inch, the opening 14 is not effective to retain the sock. A tear drop shape of the opening 14 is preferred although other shapes may be used as long as the overall configuration is wider at the top than at the bottom within the range as disclosed. The need for this configuration will be described.

The inner surface 20 of each opening 14 is smooth and has no burrs or uneven portions to ensure that members of the set, such as socks 22, to be inserted in the opening 14 are not damaged and also to facilitate insertion, retention and removal of the sock 22. Although the present device 10 can be used to sort a plurality of members forming a matched set, the set of socks has been used for ease of description and not as a limitation. It is further preferred that a portion of the inner surface 20 of each opening 14 be arcuate. The arcuate portion may be nearer to the front surface 24 or to the back surface 26 of the panel 12. It is further preferred that about the entire periphery of each opening 14, the inner surface be inclined toward the arcuate portion to an apex 28. Preferably, the apex 28 is nearer to the back surface 26 than to the front surface 24. Although the above structure is preferred, the inner surface 20 of each opening 14 may be completely arcuate. However, this configuration has been found to be less efficient in receiving and retaining the sock 22. Also, the apex 28 may be at an approximate midpoint between the front 24 and back 26 of the panel 12. These configurations have also been found to be less efficient than the preferred configuration in receiving and retaining the sock 22.

Figure 6:
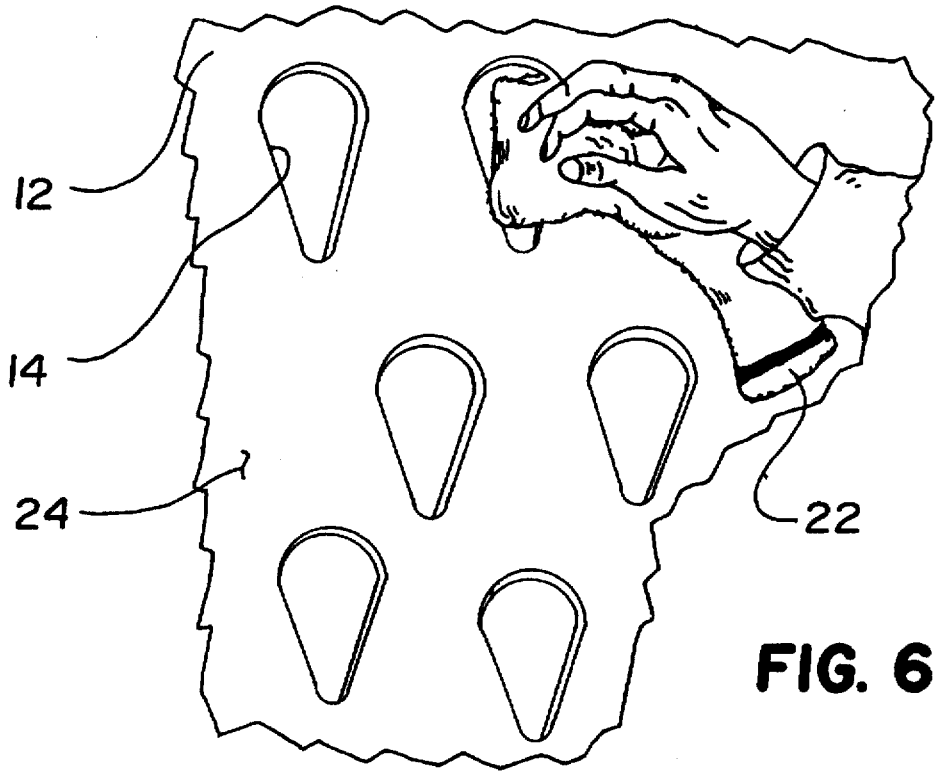
FIG. 6 is a perspective view showing insertion of a portion of a sock into an opening in the panel.
Figure 7:
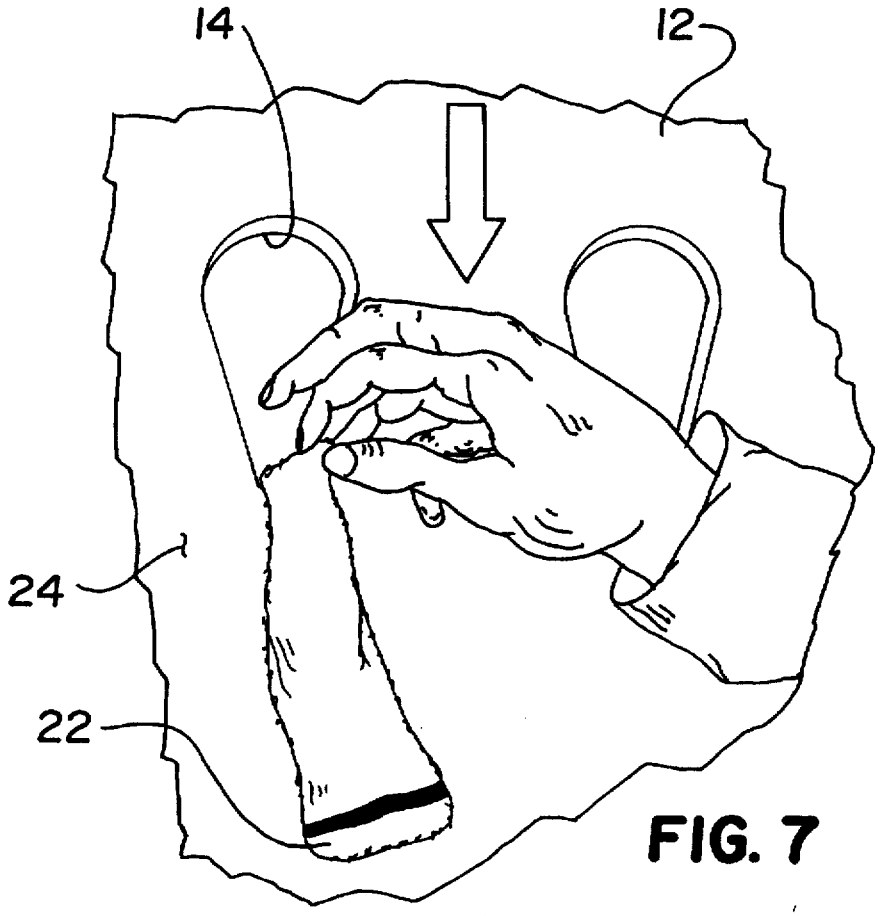
FIG. 7 is an enlarged perspective view showing the sock of FIG. 6 being pushed downwardly into the bottom of the opening.
Figure 8:
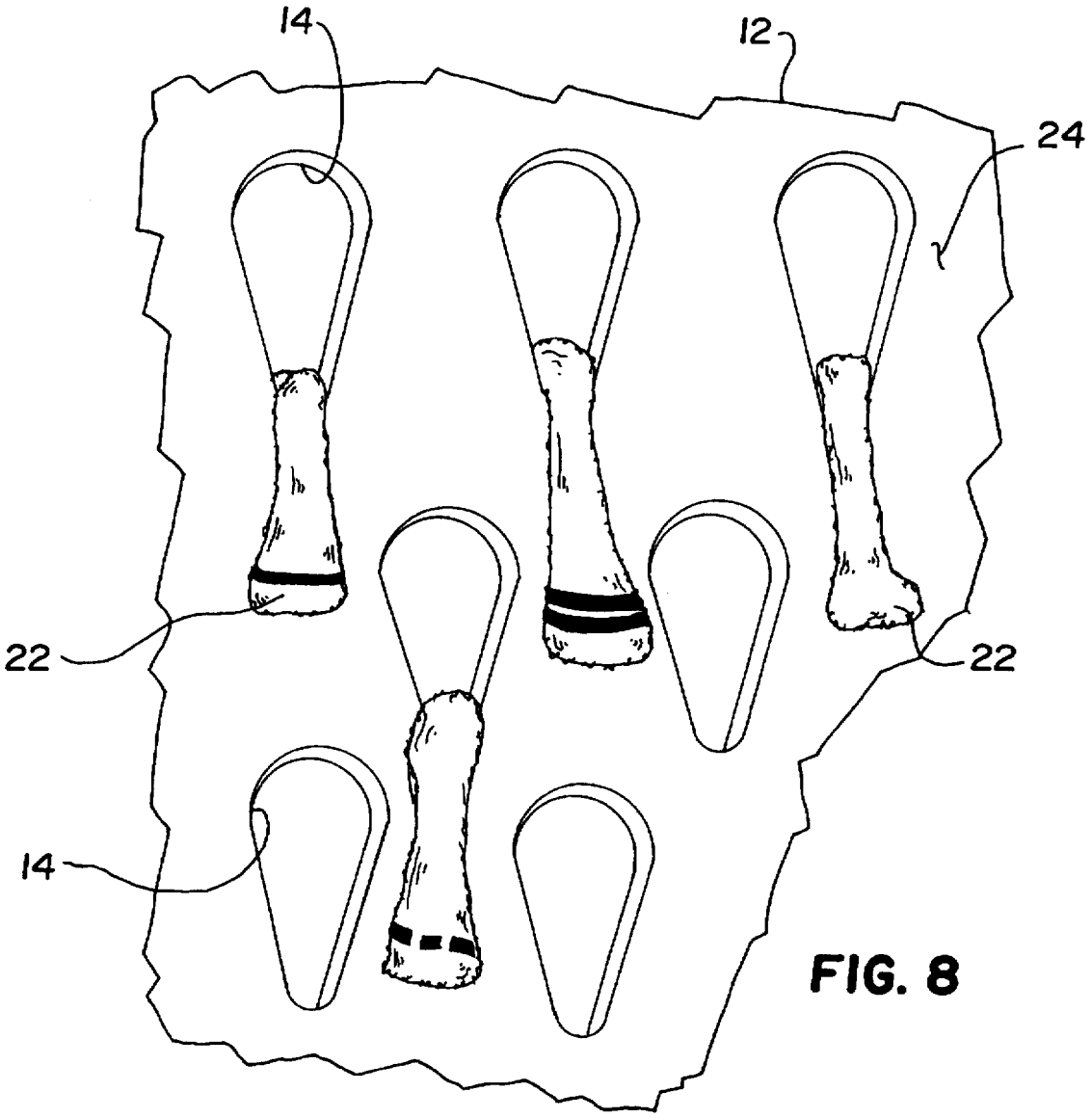
FIG. 8 is a perspective view showing a plurality of socks having another portion displayed on the front of the panel.

The panel 12 is supported in a substantially upright position or in a position with the top slightly tilted backwardly with respect to the bottom. As shown in FIGS. 6–8, one sock 22, or other garment to be mated, is picked up by the fingers of a user and using a natural hand movement, a first portion of the sock 22 is inserted, from the front 24 of the panel 12, into the top 16 of a selected one of the openings 14. The sock 22 is preferably folded in two with the fold being inserted into the opening 14. The sock 22 is pushed downwardly into the opening 14 toward the bottom 18 of the opening 14 such that the first portion of the sock 22 is wedged in the opening 14, near the bottom 18 thereof. The first portion of the sock 22 hangs out of the opening 14, extending over the back 26 of the panel 12. The remaining (second) portion of the sock 22 hangs downwardly from the bottom 18 of the selected opening 14 on the front 24 of the panel 12. In this manner, the remaining portion of the sock 22 is displayed for the user to see at a glance so that the mate to the sock 22 can be rapidly and simply identified. The plurality of openings 14 enable the user to display a number of socks 22 simultaneously.

The user sequentially picks up one of the socks from the laundry and mates the sock with a mate retained in one of the openings 14. If no mate is found, the user retains the non-mated sock in a separate retaining means (opening 14). This selection, mating and retaining is continued sequentially until all of the socks are mated or, if unmated, are displayed on the panel 12. Preferably, the rows and columns of openings 14 are staggered so that the openings 14 in each row are offset from the openings 14 in the row immediately above the row immediately below. In this manner, increased display surface is available and socks 22 suspended from any one opening 14 do not overhang and obscure lower openings 14. In order to provide the maximum number of openings 14 per unit area and still permit sufficient display space under each opening 14, the following spacing has been found to be most efficient. Each opening 14 has a respective vertical center line and in any row, the spacing between center lines is approximately four (4) inches. Each opening 14 further has a horizontal line across the greatest width of the respective opening 14. The spacing between the horizontal lines is approximately five (5) inches between each row. Since alternate rows are offset from the row immediately above and below, the result is a ten (10) inch space between openings 14 which are directly in a vertical column and approximately a two (2) inch space between the vertical center lines of openings 14 in each adjacent vertical column. When a mate is found for the displayed sock 22 the second portion of the displayed sock 22 is grasped by the fingers of the user and lifted to remove the sock 22 from the top 16 of the opening 14 to be placed with the mate. It is also possible to insert a portion of the mate into the opening 14 to have the complete pair displayed, stored and available for wear.

By use of the organizing device 10, it is possible to significantly reduce the time required to sort and mate socks 22 and other garments or articles of clothing which exist as pairs. In typical uses, for an ordinary load of laundry, the time to sort and mate socks has been reduced from fifteen (15) minutes to five (5) minutes. When the one member is displayed on the device 10, the user can rapidly see the size, color, design and pattern of the sock and can feel the texture for definitive mating. Also, if a mate is not found, the one sock 22 can be left hanging from the device 10 until the next load of laundry is completed so that the "lost" sock can be mated at a later time. The device 10 can even be used as a storage device where mated pairs are displayed and can be selected for wear as desired. No auxiliary tools or equipment are required and only one hand of the user is necessary to place or remove the sock 22 from the device 10. The socks 22 may be sorted and mated by placing the socks 22 of one family member in one segment of the panel 12 and the socks of another family member in a different segment. For example, the socks of the father may be placed in the upper right while those of the wife are in the upper left with one child's socks being in the lower left and another child's socks being in the lower right. The device 10 can be used to sort and mate socks of children as well as socks of adults.

The panel 12 must have sufficient rigidity and strength to permit the user to push the socks 22 through the openings 24. The panel 12 should not be too thick, however, so that the weight of the device 10 may restrict its portability. To strengthen the panel 12, reduce weight and reduce cost by reducing the amount of material forming the panel 12, it is preferred to form a plurality of spaced-apart ribs 42 on the back 26 of the panel 12.

Figure 2:
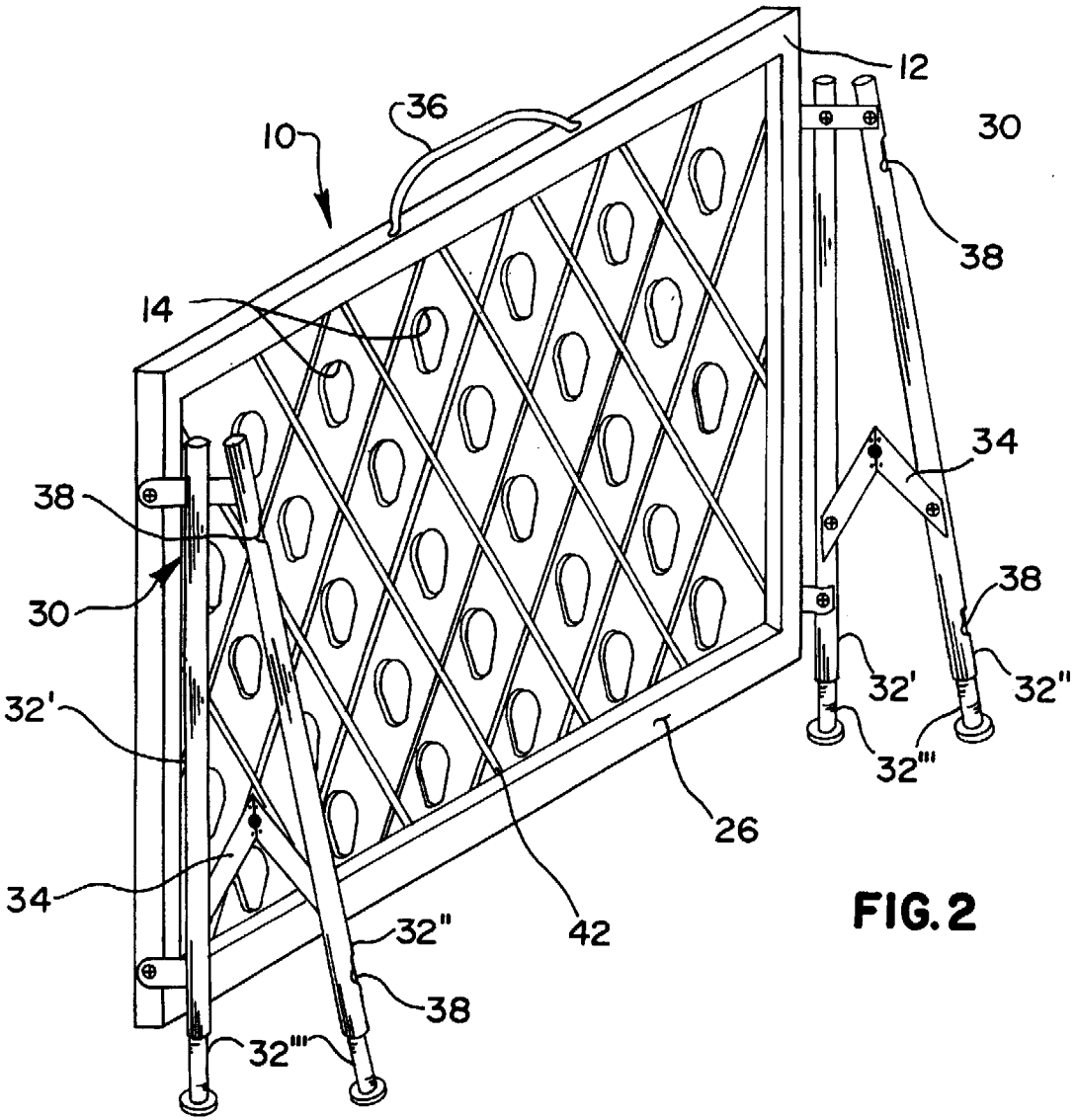
FIG 2 is a perspective view of the present invention showing the back of the device.

The panel 12 is provided with secure support means to maintain the panel 12 in a substantially upright position. In one embodiment, a foldable support means 30 such as legs 32 are connected to the back (FIGS. 1 and 2). A first pair of legs 32' are connected to the back 26 of the panel 12 or are formed as a part of the panel 12. A second pair of legs 32" are pivotably attached to the first pair of legs 32' at the top thereof so that the respective bottoms of the legs 32 may be spaced apart to provide a secure support for the panel 12. A hinged connecting member 34 is preferably disposed between the legs 32', 32" to enable said legs to be foldably disposed adjacent to one another and to be locked in an open position. The legs 32', 32" may have telescoping members 32'" so that the panel 12 may be elevated above a work surface to a height convenient to the user and also to permit display of socks 22 which are retained in the lowermost row of openings 14. The telescoping feature also provides for more convenient storage and transport of the device 10. To further assist in transport and use of the device 10, a handle 36 is formed on the top of the panel 12.

Figure 9:
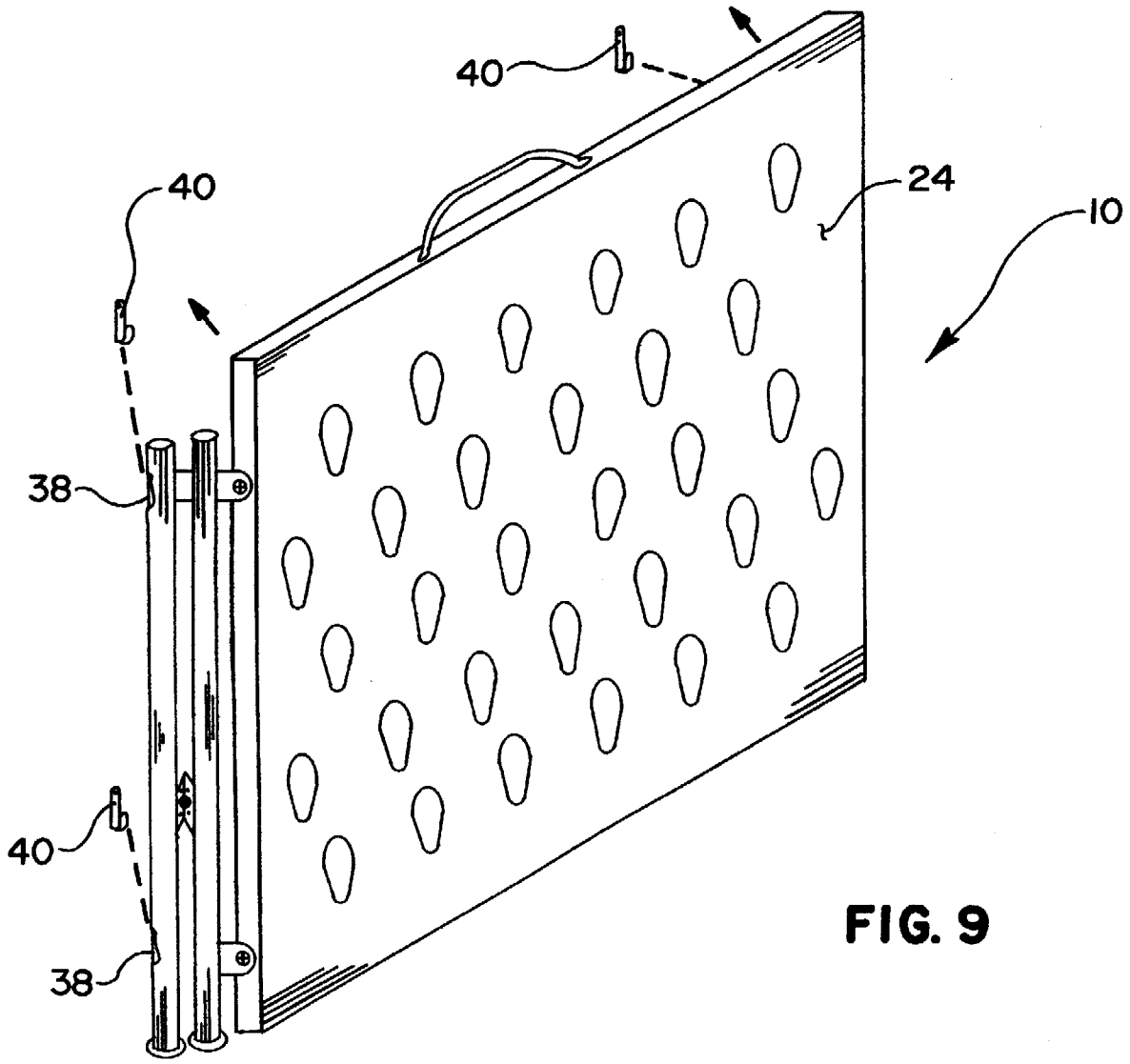
FIG. 9 is a perspective view showing the panel being removably mounted on a vertical wall.

An alternate secure support means is a surface mounting means formed on the back 26 of the panel 12. The surface mounting means may be slotted apertures 38 on the back of the panel 12, or on the legs 32, to permit the device 10 to be suspended from hooks 40 or protrusions mounted on a wall or vertical surface (FIG. 9).

In another embodiment, a separate mounting board or boards, may be attached to the wall or vertical surface and the panel 12 may be connected to the mounting boards. It is preferred that the panel 12 be mounted on the wall or vertical surface such that the back 26 of the panel 12 is approximately two (2) inches from the wall or vertical surface. This distance provides sufficient space for the user to insert a garment and for the first portion to be retained in the opening 14. These, and other means known to persons skilled in the art, are useful for securely supporting the device 10 in a substantially upright position. The device 10 can be mounted on the wall in a laundry room or in an area where the laundry is sorted. The device 10 may be of any height and width to be mounted in available space so as to improve the efficiency of sorting of the laundry.

Alternately, instead of openings 14 the panel 12 may have a plurality of spaced-apart retaining means such as rods or hook-like protrusion extending outwardly from the front 24 of the panel 12. The retaining means may alternately be a clip or clamp to hold the member.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. An organizing device for a user to manually sort and mate members of a plurality of members, the mated members forming a matched set, the device comprising:

a panel capable of holding the plurality of members, the panel having a front surface, a back surface and a plurality of spaced-apart openings formed therethrough, each opening having a top, a bottom and an inner surface thereabout, the top and the bottom each having a width, the width of the top being greater than width of the bottom, the inner surface being in a substantially smooth continuous manner from the top to the bottom of the opening, in the shape of a tear drop, whereby a portion of one member of the set is adapted to be manually inserted from the front of the panel into the top of the respective opening and pushed into said opening downwardly toward the bottom of the opening such that the portion of said member is removably retained in the respective opening, and another portion of said member of the set is adapted to hang downwardly from the bottom of the respective opening on the front of the panel, thereby adapted for displaying said member for mating with a second member of the set and further wherein a plurality of members of the sets may be inserted and retained in the corresponding plurality of openings.

2. The organizing device of claim 1, further comprising a handle means formed on the panel for ease of transport of the panel.

3. The organizing device of claim 1, further having foldable support means attached to the back of the panel for enabling the panel to be placed in the substantially upright position.

4. The organizing device of claim 1, further having mounting means attached to the back of the panel whereby the organizing device may be removably mounted on a vertical surface.

5. The organizing device of claim 1, wherein the back of the panel has ribbing formed thereon for strengthening the panel and reducing the weight and cost of the device.

6. The organizing device of claim 1, wherein the openings are in a series of horizontal rows and vertical columns, such that when members are retained in any one of the openings, said members are separated from and readily discernible from other members retained in any adjoining openings.

7. A method for a user to sort from a plurality of members, and to mate members forming a matched set wherein said matched members have at least one common feature to be mated, comprising the steps of:

providing a panel for use in combination with the members, the panel having a plurality of spaced-apart retaining means formed thereon, each retaining means being an opening in the panel and having a top having a width and a bottom having a width less than the width of the top, the width of the top permitting receipt therein of fingers of the user, the panel being secured in a substantially upright position, manually picking up a first of the plurality of unmatched members, inserting said first member in the top of a first retaining means, pushing said first member downwardly into the bottom of said first retaining means and removing the fingers from the first retaining means, thereby retaining said first member with a first of said retaining means, manually picking up a second of the plurality of unmatched members, comparing said second of said members with said first of said members to ascertain if there is at least one common feature for mating, if said comparing members have at least one common feature, removing the mated member from the panel, and matching with said unmatched member, if said comparing members do not have at least one common feature, then inserting said second non-mating member in the top of a second retaining means, pushing said second member downwardly into the bottom of said second retaining means and removing the fingers from the second retaining means, thereby retaining a non-mated second member on a second retaining means, and repeating the picking up of sequential members of the plurality of members, combining members having the at least one common feature and retaining non-mated members on sequential retaining means until all members have been mated.

8. The method of claim 7, wherein the common feature is comparing the size of the members.

9. The method of claim 7, wherein the common feature is comparing the color of the members.

10. The method of claim 7, wherein the common feature is comparing the design of the members.

11. The method of claim 7, wherein the common feature is comparing the texture of the members.

12. The method of claim 7, wherein the comparison is visual.

13. The method of claim 7, wherein the comparison is tactile.

14. The organizing device of claim 1, further comprising, the inner surface of each opening being inclined inwardly from one of the surfaces of the panel to an arcuate apex and being inclined from the apex to the other of the surfaces of the panel.

15. The organizing device of claim 14, wherein the apex is near the back surface of the panel.

16. An organizing device for a user to manually sort and mate members of a plurality of members, the mated members forming a matched set, the device comprising:

a panel capable of holding the plurality of members, the panel having a front surface, a back surface and a plurality of spaced-apart openings formed therethrough, an inner surface of each opening located between said front and back surface, being inclined inwardly from one of the surfaces of the panel to an arcuate apex and being inclined from the apex to the other of the surfaces of the panel, the top of the opening being wider than the bottom of the opening;

whereby a portion of one member of the set is adapted to be manually inserted from the front of the panel into the top of the respective opening and pushed into said opening downwardly toward the bottom of the opening such that the portion of said member is removably retained in the respective opening, and another portion of said member of the set hangs downwardly from the bottom of the respective opening on the front of the panel, thereby displaying said member for mating with a second member of the set and further wherein a plurality of members of the sets may be inserted and retained in the corresponding plurality of openings.

17. The organizing device of claim 16, wherein each opening has the width of the top of the opening being adapted to receive therein the fingers of the user.

* * * * *